United States Patent [19]

Barlow

[11] Patent Number: 4,637,148

[45] Date of Patent: Jan. 20, 1987

[54] ELECTROLUMINESCENT BADGE

[76] Inventor: Dane D. Barlow, 27840 Palmer La., Madison Heights, Mich. 48071

[21] Appl. No.: 752,618

[22] Filed: Jul. 8, 1985

[51] Int. Cl.[4] ..... A44C 3/00

[52] U.S. Cl. ..... 40/1.5; 40/544

[58] Field of Search ..... 40/1.5, 1.6, 544, 902; 362/104; 428/917

[56] References Cited

U.S. PATENT DOCUMENTS

| | | | |
|---|---|---|---|
| 3,083,317 | 3/1963 | Fish et al. | 40/544 |
| 3,521,049 | 7/1970 | Young | 362/104 |
| 3,737,647 | 6/1973 | Gomi | 362/104 |
| 3,918,184 | 11/1975 | Chao | 40/1.5 |
| 4,195,431 | 4/1980 | Neufeld | 40/544 |
| 4,494,326 | 1/1985 | Kanamori | 40/544 |
| 4,556,932 | 12/1985 | Lehrer et al. | 362/104 |

*Primary Examiner*—Gene Mancene
*Assistant Examiner*—Cary E. Stone

[57] ABSTRACT

A transparent overlay is back lit using an electroluminescent panel which is energized, either continuously or intermittently, by a battery operated electronic DC-AC inverter circuit with flasher circuit. The entire assembly including battery is housed in a lightweight plastic case, which has a fastener on the back for fastening to the wearer.

14 Claims, 4 Drawing Figures

ELECTROLUMINESCENT BADGE

BACKGROUND OF THE INVENTION

This invention relates generally to badges for promotional and display purposes, and more particularly to an electroluminescent attention-getting badge.

Conventional badges come in a wide variety of different sizes and shapes and it is generally known to provide novelty buttons and badges with various overlays and artwork representing the organization to be promoted. It is also known to provide illuminated badges using incandescent lightbulbs powered by direct-current dry cell batteries. However, one shortcoming of such illuminated badges is their relative bulk and weight. Another shortcoming is their high power drain, and thus short battery life. Also, incandescent bulbs tend to provide a point source of light and therefore illumination of the artwork tends to be uneven.

In order to overcome the foregoing disadvantages the present invention provides a badge comprising an electroluminescent panel which produces an even illumination with relatively low power drain and without the bulk of incandescent lamp-driven systems. The electroluminescent panel produces illumination when excited by an alernating current at a first potential. The invention further comprises a means for securing the panel to the wearer and a battery for supplying direct current at second potential, typically much less than the first potential. An electronic circuit transforms the direct current into alternating current at the first potential and supplies this alternating current to the panel.

In another embodiment of the invention the badge further comprises a means for periodically interrupting the illumination produced by the panel. In accordance with the invention a flasher circuit is provided for interrupting the transformed current supplied to the panel at periodic intervals, thereby interrupting the illumination produced.

For a more complete understanding of the invention reference may be had to the following detailed description and to the accompanying drawings.

DESCRIPTION OF THE PREFERRED EMBODIMENT

Figure 1:
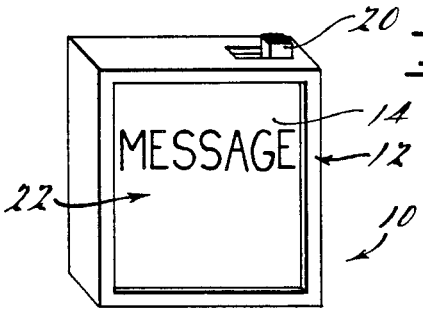
FIG. 1 is a front perspective view of the badge.
Figure 2:
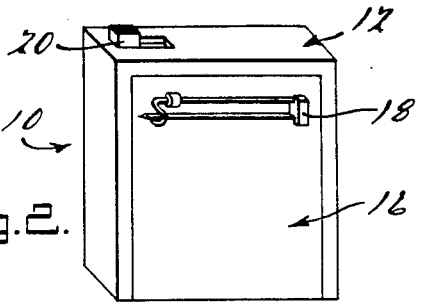
FIG. 2 is a rear perspective view of the badge.

Referring to FIGS. 1 and 2 of the drawings, the badge of the present invention is illustrated generally at 10. Badge 10 comprises a generally rectangular case 12, preferably made of plastic. Case 12 includes a rectangular window opening 14 and an integrally formed hinged rear cover 16. Cover 16, also shown in FIG. 3, snaps together with case 12 and may be opened to allow access to the batteries, yet to be described. Cover 16 also includes a hook fastener 18 for securing to the clothing of the wearer. Case 12 also includes an opening in the top thereof through which a multi-position slide switch 20 protrudes. Switch 20 is used to turn the badge on and off and is also used to select among several varying flash rates and constant illumination. Secured to the front of case 12, directly over window 14, is a transparent overlay 22. Overlay 22 may be printed to display a message, picture or promotional information. In the presently preferred embodiment, overlay 22 is secured to case 12 with adhesive. Alternatively, overlay 22 may be secured by fashioning the case with an integral channel for slidably receiving the overlay. Cover 16 is preferably attached to case 12 with an integrally formed living hinge.

Figure 3:
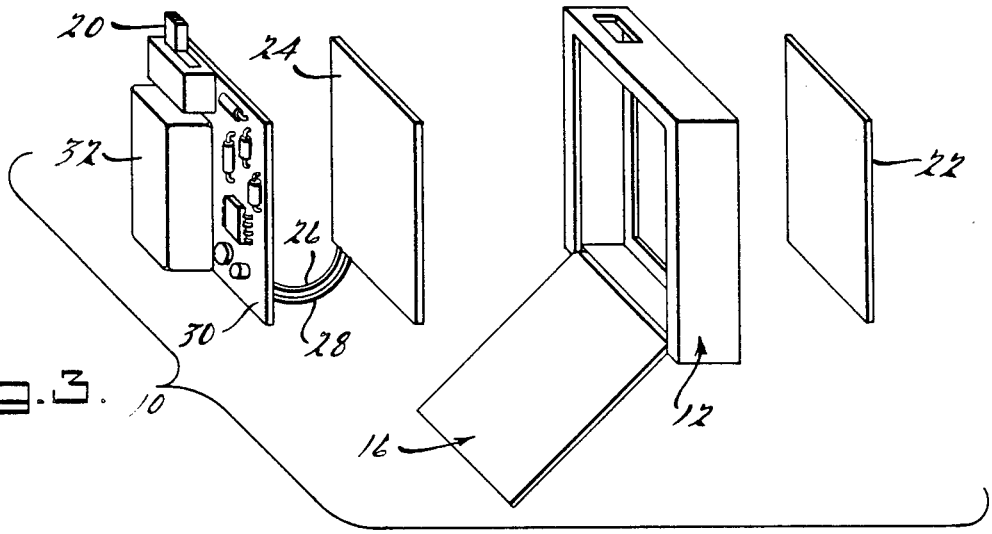
FIG. 3 is an exploded perspective view of the badge.

Referring now to FIG. 3, the badge further comprises an electroluminescent panel 24 which is electrically connected via conductors 26 and 28 to circuit board 30. Circuit board 30 includes space for battery 32. In the presently preferred embodiment battery 32 comprise a Type J alkaline dry cell battery, such as Eveready 539 or the like. However, other types of batteries are also usable. Circuit board 30 also supports the electrical components which make up the electrical circuit described in connection with FIG. 4 below. Electroluminescent panel 24 may be implemented using a flexible copolymer laminate, A.C. phosphor display as available from Ball Engineering Corporation, Westfield, Ind. Circuit board 30 and panel 24 are stacked together and frictionally held within case 12.

Figure 4:
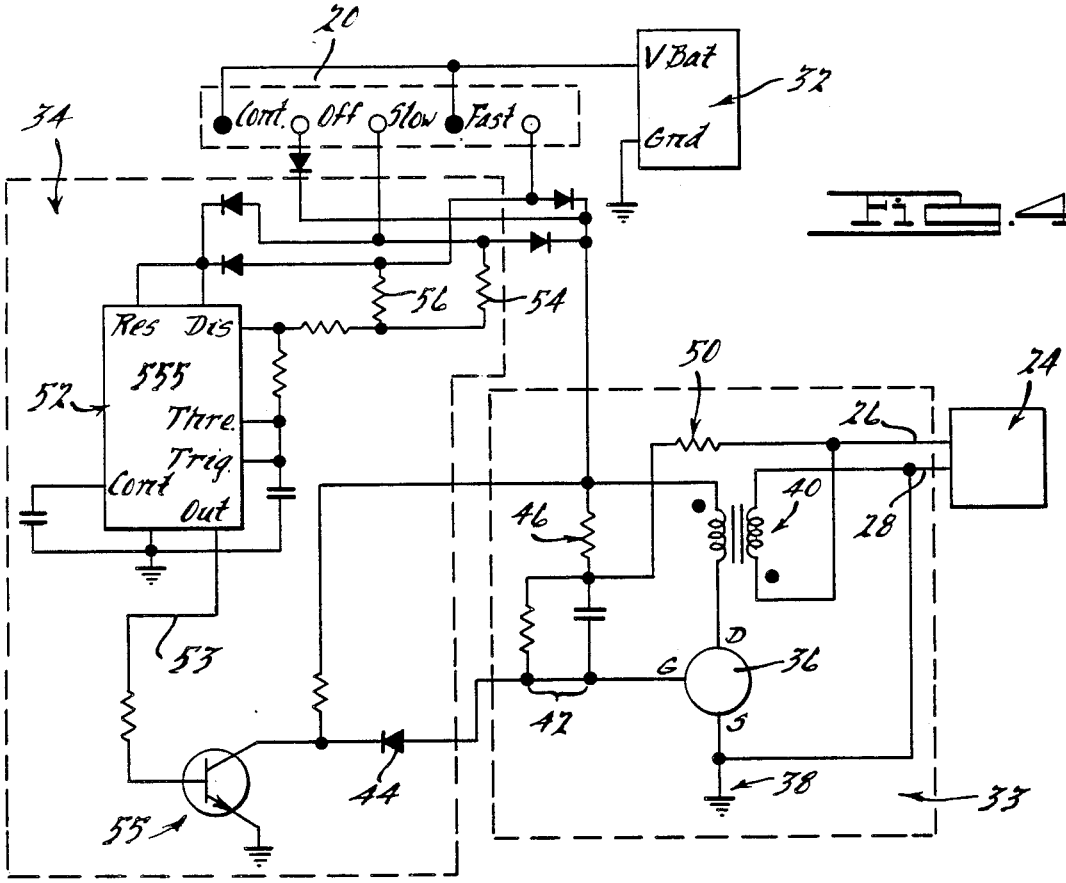
FIG. 4 is a schematic diagram illustrating the electronic circuit of the invention.

Referring now to the electronic circuit of FIG. 4, the invention further comprises a DC to AC inverter circuit 33 and a flasher circuit 34. FIG. 4 also depicts switch 20, electroluminescent panel 24 and battery 32, which were described above.

Inverter circuit 33 comprises switching transistor 36, preferably a very high gain FET device, such as 2N7000. The source of transistor 36 is grounded as at 38, while the drain is coupled to a first primary lead of transformer 40. The gate of transistor 36 is coupled to RC tank circuit 42. In the presently preferred embodiment, tank circuit resonates at approximately 1200 Hz. Also coupled to the gate of transistor 36 via diode 44 is the flasher circuit 34. Flasher circuit 34 operates to periodically short the gate to ground, thereby interrupting the oscillator circuit. The second primary lead of transformer 40 is coupled to the positive battery potential. A first secondary lead of transformer 40 is coupled to conductor 26 of panel 24, while the second secondary lead of transformer 40 is grounded. Preferably transformer 40 provides a primary inductance of 0.0015 H and a secondary inductance of 4.2 H.

The tank circuit 42 is coupled through resistor 46 to the positive battery potential. Feedback resistor 50 is coupled between conductor 26 of panel 24 and the tank circuit 42 to cause the inverter circuit to continuously oscillate.

Flasher circuit 34 comprises timer integrated circuit 52, such as a 555 timer, which is configured as an astable multivibrator. The output of timer 52, on lead 53, drives transistor 55 which is in turn coupled to the gate of transistor 36 via diode 44. When transistor 55 is in a conducting state, the gate of transistor 36 is clamped to virtual ground and the inverter circuit ceases to oscillate. The duty cycle of the output of timer 52 is selectively variable to alter the flash rate of the device. In the presently preferred embodiment, the duty cycle is altered using switch 20, which is a multi-position switch having four positions. In a first and second positions, switch 20 acts as an on off switch by interrupting the battery potential to all circuits (first position—continuous on, second position—off). In a third position, switch 20 couples a first timing resistor 54 to the timer 52 to select a 7 percent duty cycle, nominally. In a fourth position, switch 20 couples a second timing resistor 56 to the timer 52 to select a 30 percent duty cycle, nominally.

In operation, inverter circuit 33 transforms the direct current of battery 32 into alternating current at a potential substantially greater than the potential of the battery. In the preferred embodiment, battery 32 has a nominal potential of 6 volts, while inverter circuit 33 produces a quasi-sinusoidal current at a nominal potential of 130 volts RMS and at a frequency of approximately 1200 Hz.

When switch 20 is in the third position, flasher circuit 34 causes panel 24 to cyclically produce illumination for 90 mS and to be off for 950 mS, nominally. When switch 20 is in the fourth position, flasher circuit 34 causes panel 24 to cyclically produce illumination for 90 mS and to be off for 150 mS, nominally.

While the invention has been described according to the presently preferred embodiment, it will be understood that the invention is susceptible to modification and change without departing from the scope of the invention as set forth in the appended claims.

What is claimed is:

1. A badge comprising:

an electroluminescent panel having an outwardly facing planar surface which directly generates and radiates illumination when excited by an alternating current at a first potential;

a means for securing said panel to the wearer;

a battery for supplying direct current at a second potential; and an electronic circuit receptive of said direct current for transforming said direct current into alternating current at said first potential and for suppling said transformed current to said panel said electronic circuit comprising a resonant tank circuit, a transistor amplifier coupled to said tank circuit, a transformer having a primary coupled to said transistor amplifier and having a secondary coupled to said panel, and a negative feedback means coupled between said secondary and said tank circuit to maintain oscillation and to thereby deliver alternating current to said panel to produce illumination.

2. The badge of claim 1 wherein said second potential is less than said first potential.

3. The badge of claim 1 further comprising light transmissive display means positioned adjacent said panel.

4. The badge of claim 1 further comprising means for securing said battery and said electronic circuit to the wearer.

5. The badge of claim 1 further comprising enclosure means for containing said battery and said electronic circuit and for supporting said panel and wherein said means for securing is disposed on said enclosure.

6. The badge of claim 1 wherein said means for securing comprises hook fastener means.

7. The badge of claim 1 wherein said electronic circuit includes switch means for selectively interrupting the reception of said direct current.

8. The badge of claim 1 further comprising means for periodically interrupting said illumination produced by said panel.

9. A badge comprising:

an electroluminescent panel having an outwardly facing planar surface which directly generates and radiates illumination when excited by an alternating current at a first potential;

a means for securing said panel to the wearer;

a battery for supplying direct current at a second potential;

an electronic circuit receptive of said direct current for transforming said direct current into alternating current at said first potential and for supplying said transformed current to said panel;

a flasher circuit for interrupting the transformed current supplied to said panel at periodic intervals, thereby interrupting said illumination produced; and switching means for selectively bypassing said flasher circuit and for selecting a multiplicity of flash rates, comprising a single-pole multiposition switch and a diode matrix coupled to said flasher circuit and to said electronic circuit.

10. The badge of claim 9 wherein said second potential is less than said first potential.

11. The badge of claim 9 further comprising light transmissive display means positioned adjacent said panel.

12. The badge of claim 9 further comprising means for securing said battery and said electronic circuit to the wearer.

13. The badge of claim 9 further comprising enclosure means for containing said battery and said electronic circuit and for supporting said panel and wherein said means for securing is disposed on said enclosure.

14. The badge of claim 9 wherein said means forsecuring comprises hook fastener means.

* * * * *